US005827809A

United States Patent [19]

Mainz et al.

[11] Patent Number: 5,827,809

[45] Date of Patent: Oct. 27, 1998

[54] LOW-RESIDUE MACROEMULSION CLEANER WITH PERCHLOROETHYLENE

[75] Inventors: Eric L. Mainz, Colwich; Janice M. Nyberg, Wichita, both of Kans.

[73] Assignee: Vulcan Materials Company, Wichita, Kans.

[21] Appl. No.: 730,363

[22] Filed: Oct. 15, 1996

[51] Int. Cl.[6] ..... C11D 1/72; C11D 3/24; C11D 3/20; B08B 3/08

[52] U.S. Cl. ..... 510/365; 510/4.8; 510/421; 510/406; 510/256; 510/273; 134/40

[58] Field of Search ..... 510/364, 418, 510/421, 406, 256, 273, 365; 134/40, 42, 38

[56] References Cited

U.S. PATENT DOCUMENTS

| | | | |
|---|---|---|---|
| 3,553,145 | 1/1971 | Burke et al. | 252/170 |
| 3,629,004 | 12/1971 | Cooper et al. | 134/31 |
| 3,657,173 | 4/1972 | Eanzel et al. | 260/29.6 F |
| 3,723,341 | 3/1973 | Raymond et al. | 252/312 |
| 3,770,373 | 11/1973 | Schwartz | 8/142 |
| 3,773,676 | 11/1973 | Boyles | 252/171 |
| 3,839,087 | 10/1974 | Beckers | 134/31 |
| 3,856,695 | 12/1974 | Geiss et al. | 252/162 |
| 3,915,634 | 10/1975 | Pariser | 8/169 |
| 3,961,880 | 6/1976 | Reinert et al. | 8/17 |
| 4,108,599 | 8/1978 | Coll-Palagos et al. | 8/137 |
| 4,257,951 | 3/1981 | Matrick | 260/314.5 |
| 4,501,324 | 2/1985 | Sandiford et al. | 166/250 |
| 4,507,155 | 3/1985 | Cheek | 134/6 |
| 4,536,300 | 8/1985 | Kayser et al. | 252/8.55 D |
| 4,614,236 | 9/1986 | Watkins et al. | 166/304 |
| 4,744,917 | 5/1988 | Scardera et al. | 252/187.28 |
| 4,758,374 | 7/1988 | Durr et al. | 252/312 |
| 4,818,536 | 4/1989 | Meyers et al. | 424/409 |
| 4,853,039 | 8/1989 | Donegan et al. | 106/412 |
| 4,869,825 | 9/1989 | Steiner | 210/634 |
| 5,047,083 | 9/1991 | Blake et al. | 75/711 |
| 5,147,576 | 9/1992 | Montague et al. | 252/174 |
| 5,176,986 | 1/1993 | Telser et al. | 430/306 |
| 5,271,775 | 12/1993 | Asano et al. | 134/40 |
| 5,374,372 | 12/1994 | Broze et al. | 252/299.01 |
| 5,421,897 | 6/1995 | Grawe | 134/6 |
| 5,597,792 | 1/1997 | Klier et al. | 510/417 |
| 5,716,458 | 2/1998 | Machino | 134/42 |

FOREIGN PATENT DOCUMENTS

| | | |
|---|---|---|
| 552299 | 1/1986 | Australia . |
| 992425 | 7/1976 | Canada . |
| 1017906 | 9/1977 | Canada . |
| 2050931 | 3/1990 | Canada . |
| 0 075 546 | 3/1983 | European Pat. Off. . |
| 0 317 876 | 5/1989 | European Pat. Off. . |
| 1 503 902 | 3/1978 | United Kingdom . |
| WO82/02218 | 7/1982 | WIPO . |
| WO92/18600 | 10/1992 | WIPO . |
| WO94/23012 | 10/1994 | WIPO . |

OTHER PUBLICATIONS

Chen, H.H., et al., "Effect of the nature of the hydrophobic oil phase and surfactant in the formation of concentrated emulsions", J. Colloid Interface Sci., 145(1), 260–9, Month not known, 1991.

*Primary Examiner*—Douglas J. McGinty
*Attorney, Agent, or Firm*—Burns, Doane, Swecker & Mathis, L.L.P.

[57] ABSTRACT

A stable, oil-in-water macroemulsion cleaner is provided which has low toxicity, rapid evaporation rate and leaves low residue after use. The cleaner comprises perchloroethylene, water, ethanol and/or ethyl acetate, and non-ionic surfactant. The macroemulsion cleaner can be used to remove greasy and oily soils from soiled surfaces, and is non-flammable as an aerosol spray with appropriate propellant formulations.

14 Claims, No Drawings

LOW-RESIDUE MACROEMULSION CLEANER WITH PERCHLOROETHYLENE

BACKGROUND OF THE INVENTION

1. Field of the Invention

The invention relates to a water and perchloroethylene macroemulsion and its use as a low-residue cleaner.

2. Description of the Related Art

Chlorinated chemicals, such as methylchloroform, have been used in various cleaning applications. The emissive use of methylchloroform in cleaning, however, is being phased out due to its ability to deplete atmospheric ozone. Therefore, there is a need for alternative cleaning technologies.

Desired properties for alternatives to methylchloroform cleaners include low toxicity, non-flammability, rapid evaporation rate and low residue. Many aqueous technologies prove insufficient in drying time and low residue requirements. Many potential solvent alternatives possess toxicity or flammability problems.

Emulsion cleaners have been described in the art. For example, WO 92/18600 describes a microemulsion comprising an organic solvent or solvent blend having a solubility parameter of between about 6.9 and 8.9 $(cal/cm^3)^{1/2}$, sufficient surfactant to support a stable microemulsion, and water in an amount sufficient to provide a total volatile organic compounds (VOC) content of less than 200 grams/liter. Additional types of emulsion cleaners are described in, for example, U.S. Pat. No. 3,553,145, U.S. Pat. No. 4,744,917, U.S. Pat. No. 5,176,986, CA 992425, EP 0 075 546 and WO 94/23012. The known emulsion cleaners, however, also lack one or more of the aforementioned desired properties for an alternative to ozone-depleting chemicals.

While the art has made significant strides in the past, there is still a need for an alternative to methylchloroform cleaners which possesses low toxicity, non-flammability, rapid evaporation rate and leaves low residue after use.

OBJECTS AND SUMMARY OF THE INVENTION

It is therefore a general object of the present invention to provide an improved macroemulsion cleaner.

It is a more specific object of the present invention to provide a macroemulsion cleaner which has low toxicity, non-flammability, rapid evaporation rate and leaves low residue after use.

It is another object of the present invention to use such a macroemulsion cleaner for removing greasy and oily soils from a soiled surface.

Accordingly, in one aspect, the present provides a stable, oil-in-water macroemulsion low residue cleaner. The cleaner comprises perchloroethylene, water, ethanol and/or ethyl acetate, and non-ionic surfactant.

DESCRIPTION OF THE PREFERRED EMBODIMENTS OF THE INVENTION

As noted above, one aspect of the present invention relates to a stable, oil-in-water macroemulsion low residue cleaner which comprises perchloroethylene, water, ethanol and/or ethyl acetate, and non-ionic surfactant. Perchloroethylene is a chlorinated chemical that has been shown to be a non-ozone depletion chemical. Perchloroethylene is regulated in the workplace as a VOC in some states, such as California. However, when used in the macroemulsion according to the invention, the VOC content complies with regulatory standards. Thus, the macroemulsion cleaner of the invention is advantageous in that it not only offers VOC regulatory compliance, but is also as effective a cleaner as pure perchloroethylene or methylchloroform.

In general, a macroemulsion is a heterogeneous system comprising at least one immiscible liquid dispersed as droplets in another liquid. The immiscible liquid droplets have a diameter exceeding 0.1 micron. See "Emulsions & Emulsion Technology" (Kenneth J. Lissant, Ed. (1974) Marcel Dekker, Inc., p. 128), the contents of which are hereby incorporated by reference.

The macroemulsion cleaner of the invention generally contains from 35 to 65 weight % perchloroethylene, more preferably from 45 to 55 weight %, most preferably about 50 weight %. The water content of the macroemulsion cleaner of the invention generally is from 20 to 50 weight %, more preferably from 30 to 40 weight %, most preferably about 35 weight %.

The macroemulsion cleaner of the invention further comprises ethyl acetate and/or ethyl alcohol. Ethyl acetate generally provides from 0 to 15 weight % of the macroemulsion, more preferably from 5 to 10 weight %, and most preferably from 6 to 9 weight %. Ethyl alcohol also generally provides from 0 to 15 weight % of the macroemulsion, more preferably from 5 to 10 weight % and most preferably from 6 to 9 weight %.

Although ethyl alcohol is preferred, other lower alkyl (C1–C6) alcohols may be used, including methanol, isopropyl alcohol, n-propyl alcohol. Similarly, lower alkyl (C1–C6) alkyl esters may also be used, including methyl acetate, propyl acetate, ethyl formate and ethyl propionate.

The macroemulsion cleaner of the invention also comprises a non-ionic surfactant. The surfactant is necessary to obtain a stable emulsion, i.e., an emulsion that is preferably stable (i.e., visually one phase), for a minimum of four hours. If some phase separation does occur, a brief shaking or stirring action will restore the emulsion to one phase.

The preferred non-ionic surfactants for use in the present invention are oxazolines modified with one or more alkyl groups and one or more groups containing repeating units of alkylene oxides (alkyl-alkylene oxide-oxazolines). The ALKATERGE series of surface active agents (Angus Chemical) are representative of such compounds, with ALKATERGE T-IV being preferred (ethanol, 2, 2'-{(2-heptadecyl-4(5H)-oxazolylidine) bis(methylene oxy-2,1-ethanediyloxy)}bis-). ALKATERGE T-IV is also referred to as AP1136 Alkaterge. Other non-ionic surfactants may also be used as the emulsification agent according to the invention, including the TWEEN series (ethoxylated sorbitan monoleate), the SURFYNOL series of surfactants (e.g., Surfynol 61, which is 3,5-dimethyl-1-hexyn-3-ol), Aerosol OT (sodium dioctyl sulfosuccinate (75%) in mixture of ethanol and water, by Cyanamid), and Igepal CO 730 (nonylphenoxypoly(ethyleneoxy)ethanol). It is preferable to use less than 0.5 weight % of non-ionic surfactant in the macroemulsion cleaner of the present invention to limit residue. Furthermore, it is preferable to use a non-ionic surfactant which has a molecular weight lower than 350. However, greater amounts of surfactants can improve storage stability.

For example, the macroemulsion cleaner may be used in the form of an aerosol product, in which case a propellant such as dimethyl ether or blends of isobutane/propane (e.g., A70) may be included. For minimum VOC content, HFC-152a (1,1 difluoroethane) is preferred. Other propellants which may be used include HFC 134a (1,1,1,2 tetrafluoroethane); azeotropes of dimethyl ether with propane, HFC-152a or HFC-134a; and azeotropes of HFC-152a with propane, isobutane or n-butane; azeotropes of HFC-134a with propane, isobutane or n-butane.

A preferred macroemulsion cleaner of the present invention comprises in percent by weight, 50% perchloroethylene, 35% water, 7.67% ethylacetate, 6.86% ethyl alcohol and 0.44% ALKATERGE T-IV.

The various components of the macroemulsion cleaner of the present invention are combined and mixed to form a stable oil-in-water emulsion. Generally, the order of addition is perchloroethylene, water, ethanol/ethyl acetate, and surfactant.

The macroemulsion cleaner of the present invention is generally used to remove greasy and oily soils from surfaces soiled with such substances, although the macroemulsion cleaner is also effective on other types of soils. The macroemulsion cleaner is applied to the soiled surface, and the cleaner and greasy and oily soils are removed by any convenient method, for example by wiping or drip removal by gravity. The invention is advantageous in that very little residue remains on the cleaned, dry surface, preferably less-than 500 mg/m$^2$.

EXAMPLE 1

The following candidate formulations were produced, each component expressed in grams as shown in Table 1.

TABLE 1

| | Formulation | | | | | |
|---|---|---|---|---|---|---|
| Component | H | I | L | N | P | R |
| Perchloroethylene | 20.01 | 19.38 | 20.32 | 15.12 | 12.28 | 16.83 |
| Water | 12.16 | 17.33 | 16.21 | 8.42 | 6.36 | 10.48 |
| Acetone | 8.00 | | | | | |
| Tween 80 | 0.37 | | | | | |
| Surfynol 61 | 0.02 | | | | 0.22 | 0.14 |
| Ethyl acetate | | 3.31 | | | 0.31 | |
| Ethanol | | 2.96 | | | | |
| AP1136 Alkaterge | | 0.19 | 1.27 | 0.30 | | |
| Acetonitrile | | | 4.50 | | | |
| Propylene glycol | | | | 2.18 | 1.32 | |
| Aerosol OT | | | | | 0.15 | 0.41 |
| 2 Methylcyclohexanol | | | | | | 2.39 |

The above candidate macroemulsions possessed good stability (at least 4 hours) and, thus, were tested for cleaning performance, non-volatile material (NVM) residue, evaporation rate and flash point (SETA closed cup, ASTM D-3828). In order to perform the aforementioned tests, the various formulations were prepared in 1000 gram quantities in liter bottles.

Non Volatile Material (NVM)

NVM results were obtained by pouring 50 grams of each blended formulation into glass evaporating dishes and placing them in a vacuum oven set at 100° C. with 5 inches Hg vacuum. The samples were allowed to remain in these conditions overnight. The next day the temperature was increased to 105° C., vacuum was changed to 30 inches Hg, and the samples were allowed to remain overnight. On the third day, the samples were cooled to room temperature and residues were determined by weight difference. The residues left in the dishes were easily water soluble except for formulations P and R.

Evaporation Rate

Evaporation rates were determined by dipping preweighed stainless steel coupons (2"×4"×⅛" with 1"×1/16" round recesses milled into one side) into each formulation and then hanging them (vertically) to dry. Coupons were weighed on a four-place balance at the first five and ten minutes of evaporation time and every ten minutes thereafter until no discernible weight changes were seen. Therefore, if the total drying time was between 10 and 20 minutes, the time shown is 20 minutes. The data were obtained by placing the coupons in a fume hood at 20° C. with air flow not determined. Two trials were run.

Residue in mg/m$^2$ on Coupons

The same coupons as described in the evaporation rate section above that were dipped into each formulation were weighed after evaporation was complete to determine the remaining residue.

Cleaning Ability

Cleaning ability was determined for each concentrate by dipping the coupons described above in a soil mixture, dipping them into the stirred formulation, and hanging them to dry. A soil mixture was made with the following components in wt. %:

| | |
|---|---|
| Soil Mixture #1 | |
| 55.91% wt. % | Quaker State 10W30 motor oil |
| 8.49% wt. % | Iron Oxide, Aldrich #1309-37-1 |
| 5.11% wt. % | Carbon, Cabot Sterling NS1, AP-2084 |
| 30.49% wt. % | Kaolin, Fisher K2-500 |
| Soil Mixture #2 | |
| 40.00% wt. % | Soil Mixture #1 |
| 60.00% wt. % | 1,1,1-trichloroethane |

The coupons were dipped into the stirred soil #2 and hung to dry for 1 hour. To perform the cleaning test the soiled coupon was then dipped into the stirred formulation for 2 minutes and hung to dry for at least 1.5 hours. Cleaning ability was measured by the amount of residue remaining on the coupon, determined by re-weighing. Two coupons were cleaned in each formulation, with the averaged results contained in Table 2. Additional cleaning tests were performed with formulations "I" and "H", as well as with Dow Invert cleaning products, with a variety of soils. Results are shown in Table 3.

TABLE 2

| Formulation | Components | Conc. (wt %) | NVM (wt %) | Evaporation (minutes) | Residue (mg/m$^2$) | Cleaning Ability (mg/m$^2$) |
|---|---|---|---|---|---|---|
| | Perchloroethylene | 100 | — | 20 | 63 | 94 |
| | | | | 20 | | |
| H[1] | Perchloroethylene | 43.3 | 1.01 | 10 | 223 | 4669 |
| | Water | 30.0 | | 20 | 393 | |
| | Acetone | 19.7 | | | | |
| | Tween 80 | 0.91 | | | | |

TABLE 2-continued

| Formulation | Components | Conc. (wt %) | NVM (wt %) | Evaporation (minutes) | Residue (mg/m$^{2)}$ | Cleaning Ability (mg/m$^2$) |
|---|---|---|---|---|---|---|
| | Surfynol 61 | 0.05 | | | | |
| I[2] | Perchloroethylene | 50.0 | 0.42 | 30 | 0 | 295 |
| | Water | 35.0 | | 20 | 214 | |
| | Ethyl acetate | 7.67 | | | | |
| | Ethanol (denatured) | 6.86 | | | | |
| | Alkaterge T-IV | 0.44 | | | | |
| L | Perchloroethylene | 48.0 | 2.94 | 20 | 1027 | 1416 |
| | Water | 38.3 | | 20 | 1385 | |
| | Acetonitrile | 10.6 | | | | |
| | Alkaterge T-IV | 3.0 | | | | |
| N | Perchloroethylene | 58.1 | 1.11 | 110 | 599 | 9111 |
| | Water | 32.4 | | 110 | 625 | |
| | Propylene glycol | 8.38 | | | | |
| | Alkaterge T-IV | 1.15 | | | | |
| P | Perchloroethylene | 59.5 | 0.9 | 110 | 679 | 4131 |
| | Water | 30.8 | | 110 | 322 | |
| | Ethyl acetate | 1.50 | | | | |
| | Propylene glycol | 6.40 | | | | |
| | Aerosol OT | 0.73 | | | | |
| | Surfynol 61 | 1.07 | | | | |
| R | Perchloroethylene | 55.6 | 1.05 | 30 | 420 | 16624 |
| | Water | 34.6 | | 40 | 527 | |
| | 2-Methylcyclohexanol | 7.90 | | | | |
| | Aerosol OT | 1.36 | | | | |
| | Surfynol 61 | 0.46 | | | | |

[1]Formulation H exhibited a flash point of 32° F.
[2]Formulation I exhibited a flash point of 57° F.

TABLE 3

| | Cleaning Ability (mg/m$^2$)[1] | | | | | | | | | | |
|---|---|---|---|---|---|---|---|---|---|---|---|
| Formulation | Soil 1 | Soil 2 | Soil 3 | Soil 4 | Soil 5 | Soil 6 | Soil 7 | Soil 8 | Soil 9 | Soil 10 | Blank |
| Perchloroethylene | 201 | 63 | 0 | 0 | 0 | 0 | 0 | 0 | 0 | 0 | 0 |
| Dow Invert 5000 | 4140 | 1501 | 1260 | 11944 | 10908 | 3207 | 3118 | 1340 | 1590 | 1456 | 1474 |
| Dow Invert 2000 | 3024 | 1679 | 1858 | 19671 | 13463 | 1501 | 3448 | 1474 | 1233 | 1796 | 1733 |
| Dow Invert 1000 | 2073 | 1706 | 2037 | 13454 | 10845 | 4913 | 2617 | 1626 | 2215 | 1634 | 1599 |
| H[2] | 4669 | 1358 | 456 | 16964 | 13427 | 3743 | 2376 | 5297 | 724 | 241 | 491 |
| I[3] | 295 | 197 | 80 | 161 | 9630 | 0 | 0 | 0 | 0 | 0 | 98 |
| Trichloroethane | 344 | 0 | 0 | 0 | 0 | 0 | 0 | 152 | 0 | 0 | 0 |

[1]For Soil 1, each soiled coupon was dipped for 2 minutes in one jar of solution, with 2 coupons cleaned per formulation. For all other soils, each soiled coupon was dipped into a first jar of solution for 1 minute, then into a second jar of fresh solution for 1 minute, with one coupon cleaned per formulation.
[2]Formulation H is as described in Table 2.
[3]Formulation I is as described in Table 2.
Soil 1 - Brake Soil Formulation.
Soil 2 - Automatic transmission fluid: Havoline.
Soil 3 - Trim Sol: Master Chemical, water soluble cutting fluid.
Soil 4 - Cool Draw: Oakite, water soluble drawing oil.
Soil 5 - Draw Clean G: Oakite, non-water soluble drawing oil.
Soil 6 - Mineral Oil: Fisher, heavy paraffin oil.
Soil 7 - Motor Oil: Quaker State 10W30.
Soil 8 - Lithium Grease: Valvoline.
Soil 9 - Permanent Marker: Sanford black felt marker.
Soil 10 - Qual Star: Cincinnati Milacron, water soluble cutting oil, 25% in water.
Blank - Coupon without any soil dipped in cleaner.

EXAMPLE 2

The candidate formulations were also tested as potential aerosol products using either dimethyl ether (DME) or A70 (isobutane/propane) propellant. Properties measured included pH, formulation stability with propellant, spray patterns and aerosol flammability. The targeted vapor pressure for the experimental products was 35 to 50 psig. The pH of each formulation was measured by spraying the aerosol onto pH paper and noting the color. The flame extension test was performed according to DOT specifications. To determine formulation stability, the aerosols were prepared in clear glass compatibility bottles for observation. The results are presented in Table 4.

TABLE 4

| Formulation | Components | Total wt % | Aerosol Bottle Pressure (psig) | Spray Pattern/ Behavior | Stability (overnight) | Flame Extension Test | pH |
|---|---|---|---|---|---|---|---|
| H | Perchloroethylene | 35.7 | 50 | Some foaming but then sheeting action good. Not as good as L. | One layer, but starting separation. | Very flammable. | 7 |
| | Water | 21.7 | | | | | |
| | Acetone | 14.3 | | | | | |
| | Tween 80 | 0.66 | | | | | |
| | Surfynol 61 | 0.04 | | | | | |
| | DME | 27.7 | | | | | |
| I (DME) | Perchloroethylene | 35.4 | 44 | Not evaluated. | One layer, but starting separation. | Flammable Pressure range during discharge 44 to 23 psig. | 7 |
| | Water | 24.8 | | | | | |
| | Ethyl acetate | 5.43 | | | | | |
| | Ethanol | 4.85 | | | | | |
| | Alkaterge T-IV | 0.31 | | | | | |
| | DME | 29.2 | | | | | |
| I (DME/A70) | Perchloroethylene | 42.0 | 42 | Breaks apart quickly, some streaking. Does not sheet. | Used after two hours, not allowed to settle overnight. Emulsion stable over the 2 hours observed. | No flame extension seen. Pressure range during discharge 32 to 22 psig. | — |
| | Water | 29.4 | | | | | |
| | Ethyl acetate | 6.45 | | | | | |
| | Ethanol | 5.77 | | | | | |
| | Alkaterge T-IV | 0.37 | | | | | |
| | DME | 10.1 | | | | | |
| | A70 | 5.81 | | | | | |
| I (A70) | Perchloroethylene | 44.3 | 39 | Foamier but breaks apart rapidly, does not sheet thinly. Foam slides as unit, seems to "carry-off" soil | Used after two hours, not allowed to settle overnight. Emulsion stable over the 2 hours observed. | No flame extension seen. Pressure range during discharge 28 to 19 psig. | — |
| | Water | 31.0 | | | | | |
| | Ethyl acetate | 6.8 | | | | | |
| | Ethanol | 6.08 | | | | | |
| | Alkaterge T-IV | 0.39 | | | | | |
| | A70 | 11.4 | | | | | |
| L | Perchloroethylene | 30.6 | 38 | Wide. Good sheeting. | Two layers. | Wide spray. Flammable. | 8 |
| | Water | 24.4 | | | | | |
| | Acetonitrile | 6.78 | | | | | |
| | Alkaterge T-IV | 1.92 | | | | | |
| | DME | 36.3 | | | | | |
| N | Perchloroethylene | 44.0 | 45 | Less thick, good sheeting. No water droplets seen. | One layer. | Variable flammability. | 8 |
| | Water | 24.5 | | | | | |
| | Propylene glycol | 6.34 | | | | | |
| | Alkaterge T-IV | 0.87 | | | | | |
| | DME | 24.3 | | | | | |
| P | Perchloroethylene | 33.6 | 50 | Foamier than H but then sheets, streaks, after standing water droplets seen. | Two layers. | Very flammable. | 7 |
| | Water | 17.4 | | | | | |
| | Ethyl acetate | 0.84 | | | | | |
| | Propylene glycol | 3.61 | | | | | |
| | Aerosol OT | 0.42 | | | | | |
| | Surfynol 61 | 0.61 | | | | | |
| | DME | 43.6 | | | | | |
| R | Perchloroethylene | 43.2 | 43 | Foamiest but quickly sheets. Does streak but very small water droplets after standing. | Two layers. | Very flammable. | 8 |
| | Water | 26.9 | | | | | |
| | 2-Methylcyclohexanol | 6.14 | | | | | |
| | Aerosol OT | 1.06 | | | | | |
| | Surfynol 61 | 0.35 | | | | | |
| | DME | 22.3 | | | | | |

EXAMPLE 3

In order to lower total VOC content, formulations according to the invention were tested using 1,1-difluoroethane as propellant. The formulation had the following compositions and properties:

TABLE V

| % Component | Aerosol A | Aerosol B |
|---|---|---|
| Perchloroethylene | 36.71 | 42.61 |
| Water | 25.70 | 29.83 |
| Ethyl Acetate | 5.03 | 5.84 |
| Ethanol | 5.65 | 6.56 |

TABLE V-continued

| % Component | Aerosol A | Aerosol B |
|---|---|---|
| Alkaterge T-IV | 0.33 | 0.38 |
| Dymel ® 152A | 26.59 | 14.78 |
| Observed Aerosol Pressure, psig | 52 | 45 |

The propellant was added via a liquid propellant station, which used nitrogen to force the liquid into an aerosol bottle. The aerosol bottles were shaken following the addition of the propellant to the concentrate. After standing for 3.5 hours, Aerosol A had separated slightly into two layers. Some separation was just barely observed for Aerosol B.

Both formulations tested as non-flammable by the DOT aerosol flame extension test. These aerosol formulations contain between 47% and 55% VOC components and maintain sufficient emulsion stability for cleaning performance.

Although preferred embodiments of the invention have been described above, it will be appreciated that many modifications and variations of the present invention are possible in light of the above teachings and within the purview of the appended claims without departing from the spirit and intended scope of the invention.

What is claimed is:

1. A stable, oil-in-water macroemulsion low-residue cleaner comprising, by weight, about 35% to about 65% perchloroethylene, about 20% to about 50% water, up to about 15% ethanol, up to about 15% ethyl acetate, and non-ionic surfactant present in an amount of 0.5% or less, wherein at least 5% ethanol or ethyl acetate is present.

2. A method of cleaning greasy and oily soils from a surface comprising the steps of:

a) applying the macroemulsion cleaner according to claim 1 to said surface; and b) removing said macroemulsion cleaner and said greasy and oily soils from said surface.

3. The macroemulsion cleaner according to claim 1, wherein the non-ionic surfactant is an alkyl-alkyleneoxide-oxazoline.

4. The macroemulsion cleaner according to claim 3, wherein the non-ionic surfactant is an alkyl-ethylene oxide-oxazoline.

5. The macroemulsion cleaner according to claim 1, wherein the non-ionic surfactant has a molecular weight lower than 350.

6. The macroemulsion cleaner according to claim 1, said cleaner leaving less than 500 $mg/m^2$ of residue on a surface after being used to clean said surface which has been soiled with lithium grease.

7. The macroemulsion cleaner according to claim 1, said cleaner leaving less than 500 $mg/m^2$ of residue on a surface after being used to clean said surface which has been soiled with water soluble drawing oil.

8. The macroemulsion cleaner according to claim 1, said cleaner comprising an aerosol propellant.

9. The macromolecular cleaner according to claim 8, wherein said aerosol propellant is dimethyl ether.

10. The macromolecular cleaner according to claim 8, wherein said aerosol propellant is a mixture of isobutane and propane.

11. The macromolecular cleaner according to claim 8, wherein said aerosol propellant is 1,1-difluoroethane.

12. The macroemulsion cleaner according to claim 1, comprising, by weight %, 50% perchloro-ethylene, 35% water, 7.67% ethyl acetate, 6.86% ethanol, and 0.44% ethanol, 2,2'-{(2-heptadecyl-4(5H)-oxazolylidine) bis (methylene oxy-2,1-ethanediyloxy)}bis-.

13. The method according to claim 2, wherein said macroemulsion cleaner is formed into an aerosol spray before it is applied to said surface.

14. The method according to claim 2, wherein less than 500 $mg/m^2$ of residue remains on said surface after removal of said macromolecular cleaner and said greasy and oily soils.

* * * * *